US007261377B2

(12) United States Patent
Ehud

(10) Patent No.: US 7,261,377 B2
(45) Date of Patent: Aug. 28, 2007

(54) STACKABLE MULTI-FUNCTIONAL FURNITURE

(76) Inventor: Ben Avi Ehud, Kibbutz Gazit (IL)

( * ) Notice: Subject to any disclaimer, the term of this patent is extended or adjusted under 35 U.S.C. 154(b) by 0 days.

(21) Appl. No.: 11/230,832

(22) Filed: Sep. 20, 2005

(65) Prior Publication Data

US 2007/0063555 A1 Mar. 22, 2007

(51) Int. Cl.
*A47C 7/00* (2006.01)
*A47C 13/00* (2006.01)
*A47C 3/04* (2006.01)

(52) U.S. Cl. ..... 297/283.1; 297/118; 297/119; 297/239

(58) Field of Classification Search ..... 297/378.1, 297/239, 283.1, 118, 129, 283.3, 94, 119
See application file for complete search history.

(56) References Cited

U.S. PATENT DOCUMENTS 2,357,214 A * 8/1944 McDole ..... 312/235.4
2,655,203 A * 10/1953 Wegner ..... 297/105
2,693,846 A * 11/1954 Luttio ..... 297/105
2,896,695 A * 7/1959 Ashworth ..... 297/105
3,532,378 A * 10/1970 Dalia ..... 297/118
3,817,574 A * 6/1974 McNab ..... 297/188.04
3,964,790 A * 6/1976 Bergeron ..... 297/451.5
6,116,682 A * 9/2000 Baur ..... 297/181
6,170,908 B1 * 1/2001 Jewell ..... 297/118
6,270,155 B1 * 8/2001 Rashid ..... 297/1

* cited by examiner

*Primary Examiner*—Milton Nelson, Jr.
(74) *Attorney, Agent, or Firm*—N Paul Friederichs

(57) ABSTRACT

Novel and unique stackable multi-functional furniture is provided with a single hinge connecting two portions wherein one of the two portions is adapted to rotate about the hinge so that in some arrangements such as a container or a table, a surface comprising a portion of both portions is formed and in another arrangement, which establishes a chair, one of the portions is rotated about the hinge so that one portion is on top of the other.

8 Claims, 5 Drawing Sheets a b c d e

STACKABLE MULTI-FUNCTIONAL FURNITURE

FIELD OF THE INVENTION

The present invention relates to convertible furniture. More particularly, the present invention relates to stackable multi-functional furniture that can be converted so as to be used for different uses.

BACKGROUND OF THE INVENTION

Convertible furniture is known in the art. The effectiveness of convertible furniture is that one can use the same furniture for more than one use instead of having two or three different furniture items. This saves costs as well as space. As many functions the convertible furniture can exhibit and as much the simplicity of the conversion process, the more effective the furniture is.

Many multi-functional furniture items are difficult to handle since in order to convert the function of the furniture, it has to be disassembled and assembles again in a different configuration such as taught in U.S. Pat. No. 6,367,874 "multi-functional furniture" by Casini filed in 2001 where a children's convertible furniture can be used as a bassinet, cradle, bench, desk, rocking bench, high chair or changing table. Although many functions are available, the conversion is complicated. Similarly, Pendleton et al. describe in U.S. Pat. No. 4,925,245 "device convertible into a chair, table, bed or stool" filed in 1989 a device that include at least two stackable frames that one of them is provided with a housing for telescopic legs or plate and includes vertical and horizontal openings for removably receiving a backrest in the horizontal or vertical orientation. Other parts are attachable to the device. In furniture disclosed in Great Britain patent no. 195545 "A new or improved combination chair and table" published in 1923, a table is convertible into a chair. Again, Hinge pins have to be taken in and out in order to perform the conversion. As seen, the furniture exhibit multi-functions; however, the conversion from one function to the other is difficult and complicated.

There are existing furniture items in which there were attempts to simplify the conversion process. Holland published a convertible ironing board, ladder and chair in GB 437535 where he describes furniture comprising several parts that are connected by hinges. It is also disclosed in U.S. Pat. No. 4,177,737 "Foldable convertible stool-table-bar" by Brickman a collapsible camp chair that is convertible into a table adapted to retain various types of contents in a stable position.

Nevertheless and although a vast amount of furniture possibilities are disclosed in patent documents, there is no effective furniture item that is convertible in a simple and comfort manner and is fully stackable so as to ensure space saving.

SUMMARY OF THE INVENTION

It is an object of the present invention to provide stackable multi-functional furniture that is easy to convert and has several functions.

It is another object of the present invention to provide stackable multi-functional furniture that is allowed to be stacked one on top of the other so as to occupy minimal space.

It is thus provided in accordance with the present invention, A stackable multi-functional furniture comprising a container-shaped member cut into two portions that are connected by a hinge wherein said two portions are arranged about said hinge to establish different furniture items.

Furthermore, it accordance with another preferred embodiment of the present invention, the cut between said two portions is vertically diagonal.

Furthermore, it accordance with another preferred embodiment of the present invention, said, two portions comprises:

- a first portion adapted to act as a support in some functions of the furniture, wherein said first portion has a horizontal surface;
- a second portion having a second surface connected to said first portion through said hinge provided between said horizontal surface and said second surface wherein said second portion is adapted to partially rotate substantially in 180° about said hinge between a first position in which said horizontal surface is aligned with said second surface and a second position in which said second surface is adjacently mounted on top of said horizontal surface;
- wherein, in the first position of the furniture, a container is established wherein turning the container upside down forms another function which is a stool or a table, and wherein rotating said second portion about said hinge in an upward position to said second position forms a chair.

Furthermore, it accordance with another preferred embodiment of the present invention, said first portion is bigger than said second portion and provides the needed support to the furniture, especially when arranged as a chair.

Furthermore, it accordance with another preferred embodiment of the present invention, the furniture is further provided with a fastener adapted to lock said furniture when arranged in said second position.

Furthermore, it accordance with another preferred embodiment of the present invention, the furniture further provided with a snap adapted to assure that said first position is secured.

Furthermore, it accordance with another preferred embodiment of the present invention, a plurality of the furniture can be stacked when arranged in said first position.

Furthermore, it accordance with another preferred embodiment of the present invention, said horizontal surface and said second surface is provided with raisers adapted to lift the surfaces of the ground when said furniture is arranged as a container.

Furthermore, it accordance with another preferred embodiment of the present invention, a seat is provided connected to said first portion so as to allow a load to be mounted on the seat when the furniture is arranged in said second position.

Furthermore, it accordance with another preferred embodiment of the present invention, said seat is hidden beneath said horizontal surface and said second surface when the furniture is arranged in said first position.

Furthermore, it accordance with another preferred embodiment of the present invention, at least one hole is provided in said two portions so as to facilitate the conversion between the functions.

Furthermore, it accordance with another preferred embodiment of the present invention, when the furniture is arranged as a container, said container is provided with a cover.

Furthermore, it accordance with another preferred embodiment of the present invention, said hinge is flat and is substantially aligned with said container-shaped member.

Additionally, it accordance with another preferred embodiment of the present invention, the furniture is provided with protrusions adapted to raise the furniture of the ground in some of the furniture items.

BRIEF DESCRIPTION OF THE FIGURES

In order to better understand the present invention and appreciate its practical applications, the following Figures are attached and references herein. Like components are denoted by like reference numerals.

It should be noted that the figures are given as examples and preferred embodiments only and in no way limit the scope of the present invention as defined in the appending Description and Claims.

DETAILED DESCRIPTION OF THE INVENTION AND FIGURES

Figure 1:
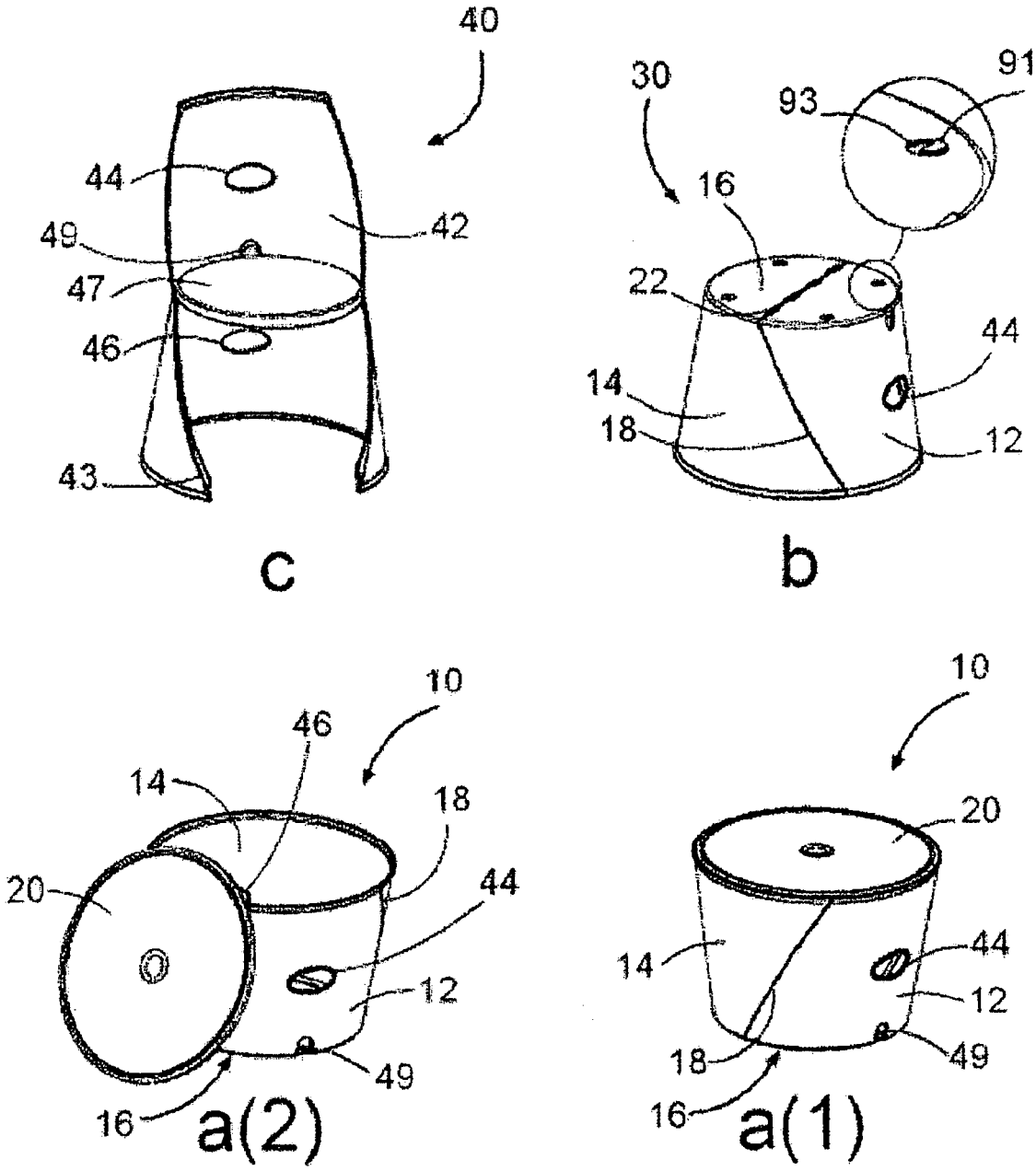
FIGS. 1*a*(1–2)-*c* illustrate different isometric views of multi-functional furniture in accordance with a preferred embodiment of the present invention, exhibiting different functions.

The present invention provides unique and novel multi-functional furniture that can be converted into several furniture items: a chair, a table, a stool, and a storing container. The conversion between the different items is simple and easy due to a single hinge that is provided between two portions that comprise the multi-functional furniture.

An additional feature of the multi-functional furniture of the present invention is that a plurality of items can be stacked within a stack that occupies minimal space. This feature is beneficial for storing the items in a storage house or within a home and for transportation of the items from one place to another.

Reference is now made to FIGS. 1*a*–*c* illustrating different isometric views of multi-functional furniture in accordance with a preferred embodiment of the present invention, exhibiting different functions. The multi-functional furniture of the present invention can be arranged as a storing container 10 (FIGS. 1*a*(1–2)). Storing container comprises two portions 12 and 14 connected by a hinge (the hinge cannot be seen in FIG. 1*a*). The hinge is provided in the base 16 of container 10 that sets up a common surface of the two portions. The two portions are preferably a consequence of a single cut of container 10. The cut has two opposite cuts 18 on the container sides while each cut is provided on one side of the container and both cuts are connected by a cut on base 16. Storing container 10 can be provided with a cover 20 (FIG. 1*a*(1)) that can be partially removed as shown in FIG. 1*a*(2) or totally removed.

When storing container is placed upside down and base 16 is arranged as a top, a table or a stool 30 is established (shown in FIG. 1*b*). The same arrangement of portions 12 and 14 is maintained while in this Figure, several hinges 22 between the portions are clearly seen.

The third arrangement of the multi-functional furniture of the present invention is shown in FIG. 1*c* in the shape of a chair 40 that is provided with a back rest 42. Back rest 42 is portion 12 of the other arrangement when it is upwardly rotated about hinge 22. A seat 47 is provided that is integrated within portion 42 while in the closed state is adjacent below base 16 of the container/table and in the open state is adjacent and mounted above the base.

It should be mentioned that hinge 22 can be formed by any type of hinge while a number of hinges can perform the action. Four hinges are shown in FIG. 1*b* as an example. An important feature of the hinge is that it should be flat and aligned with the surface in order to avoid disturbances while using the furniture.

Optionally, holes 44 and 46 are provided so as to facilitate the transformation between the different functions of the multi-functional furniture as well as its transportation.

It is important to notice that fastener 49 is provided in portion 12 that in case of a chair, is mounted on top of portion 14. Fastener 49 is adapted to lock both portions together in a case of a chair so as to prevent its collapse under load.

Snap 43 for locking the furniture in a container/table/stool option is optionally provided. A magnetic snap for connecting the two portions together can be provided as well as any other option without limiting the scope of the present invention.

Optionally, raisers 91 are provided on base 16 so as to elevate the furniture of the ground when the furniture is on the base. However, adjacent to each raiser 91, a corresponding recess 93 (shown clearly in the enlargement view of FIG. 1*b*) is provided so that when the chair 40 is arranged, each raiser is inserted within the corresponding recess and there is no gap between the folded portions in the base. This also prevents any disturbance to the operation of the hinges.

Figure 2:
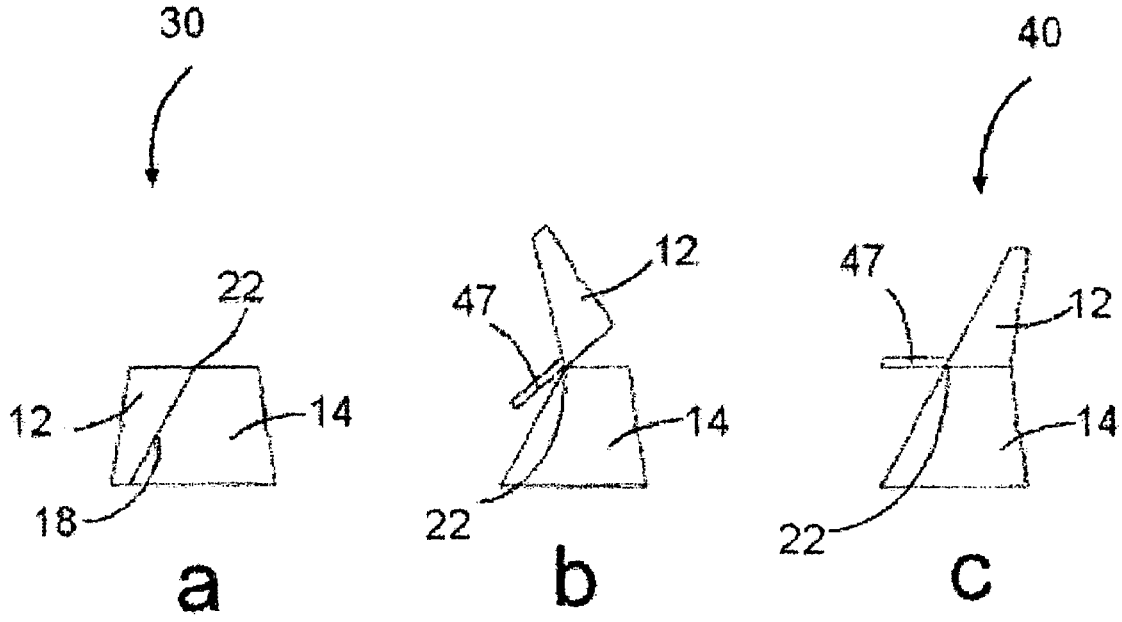
FIGS. 2*a*–*c* illustrate conversion of the multi-functional furniture shown in FIG. 1, converted from a table or a stool to a chair.

Reference is now made to FIGS. 2*a*–*c* illustrating conversion of the multi-functional furniture shown in FIG. 1, converted from a table or a stool to a chair. In FIG. 2*a*, table or stool 30 is shown wherein cut 18 is clearly seen. FIG. 2*b* illustrates a stage of separating portion 12 from portion 14 while rotating portion 12 about hinge 22. In FIG. 2*c*, chair 40 is fully established while seat 47 is protruding, allowing a person to seat on the chair while having portion 12 functioning as a back rest as shown in FIG. 1. It can be seen that cut 18 divides the furniture to two portions in a diagonal manner so that one of the portions, portion 14, is bigger than the other and acts as a support that supports the chair on the floor.

Figure 3:
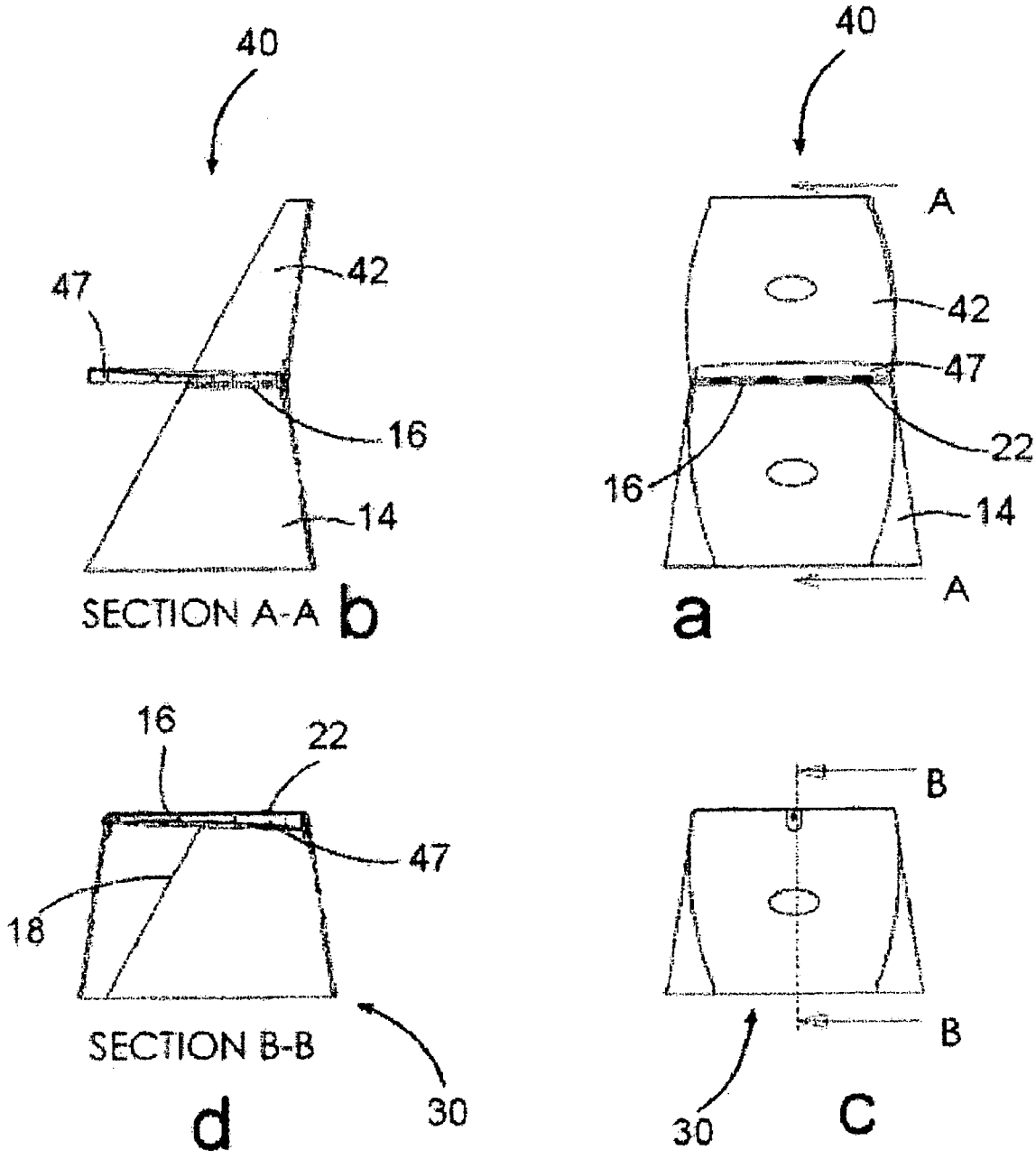
FIGS. 3*a*–*d* illustrate two views, front view and cross sectional view, of the multi-functional furniture shown in FIG. 1, arranged as a chair and as a table/stool.

Reference is now made to FIGS. 3 *a*–*d* illustrating two views, front view and cross sectional view, of the multi-functional furniture shown in FIG. 1, arranged as a chair and as a table/stool. Chair 40 is shown from its front side (a), and cross sectioned (b). Similarly, table/stool 30 is also shown in a front view (c) and cross sectional view (d). FIGS. 3*a* and *b*, clearly show the relations between the portions arranged as chair 40. Back rest 42 is basically a part of portion 12 that is mounted in this arrangement on top of portion 14. Base 16 is not arranged as a surface and is folded about hinges 22. In FIG. 3*d*, it is shown that base 16 is exposed in the upper portion of table/stool 30 and seat 47 is hidden beneath it.

Figure 4:
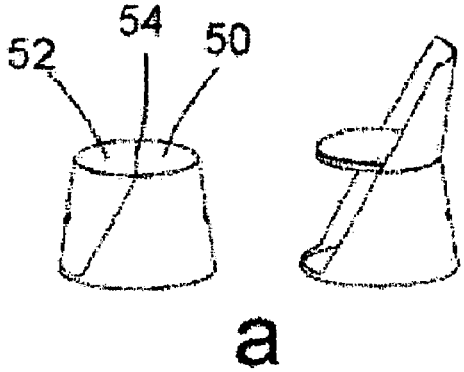
FIGS. 4*a*–*e* illustrate design options of multi-functional furniture in accordance with preferred embodiments of the present to invention.
Figure 4:
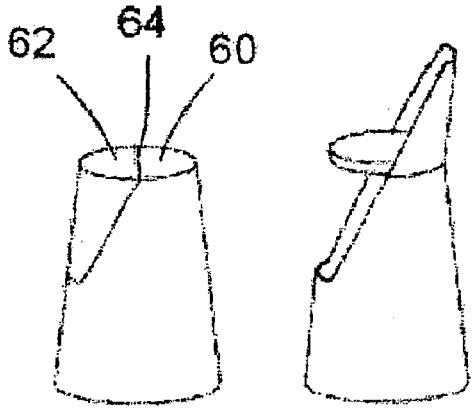
Figure 4:
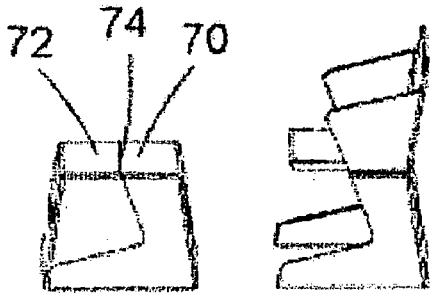
Figure 4:
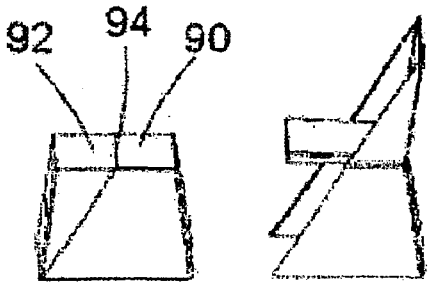
Figure 4:
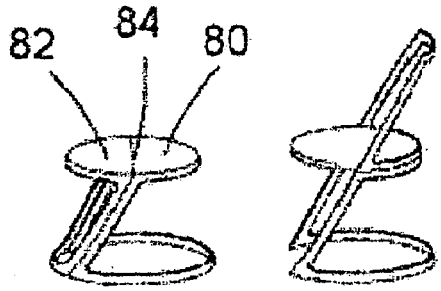

Reference is now made to FIGS. 4 *a*–*e* illustrating design options of multi-functional furniture in accordance with preferred embodiments of the present invention. It should be mentioned that the optional arrangements shown herein are provided as examples while any other arrangement can be prepared without limiting the scope of the present invention. FIG. 4*a* shows chair and stool arrangements on one design while FIGS. 4*b–e* shows other possibilities of chair and stool designs. All designs are arranged and have the same physical characters of the embodiments shown herein before: two portions 50, 52; 60, 62; 70, 72; 80, 82, and 90, 92 respectively, that rotate about a central hinge 54, 64, 74, 84, and 94, respectively. The specific designs will determine the type of usage for the components. For example, embodiment shown in FIG. 4*e* can be used as shown—a chair and a stool/table, however, cannot be used as a container. The other designs that are solid built can be used as containers.

Figure 5:
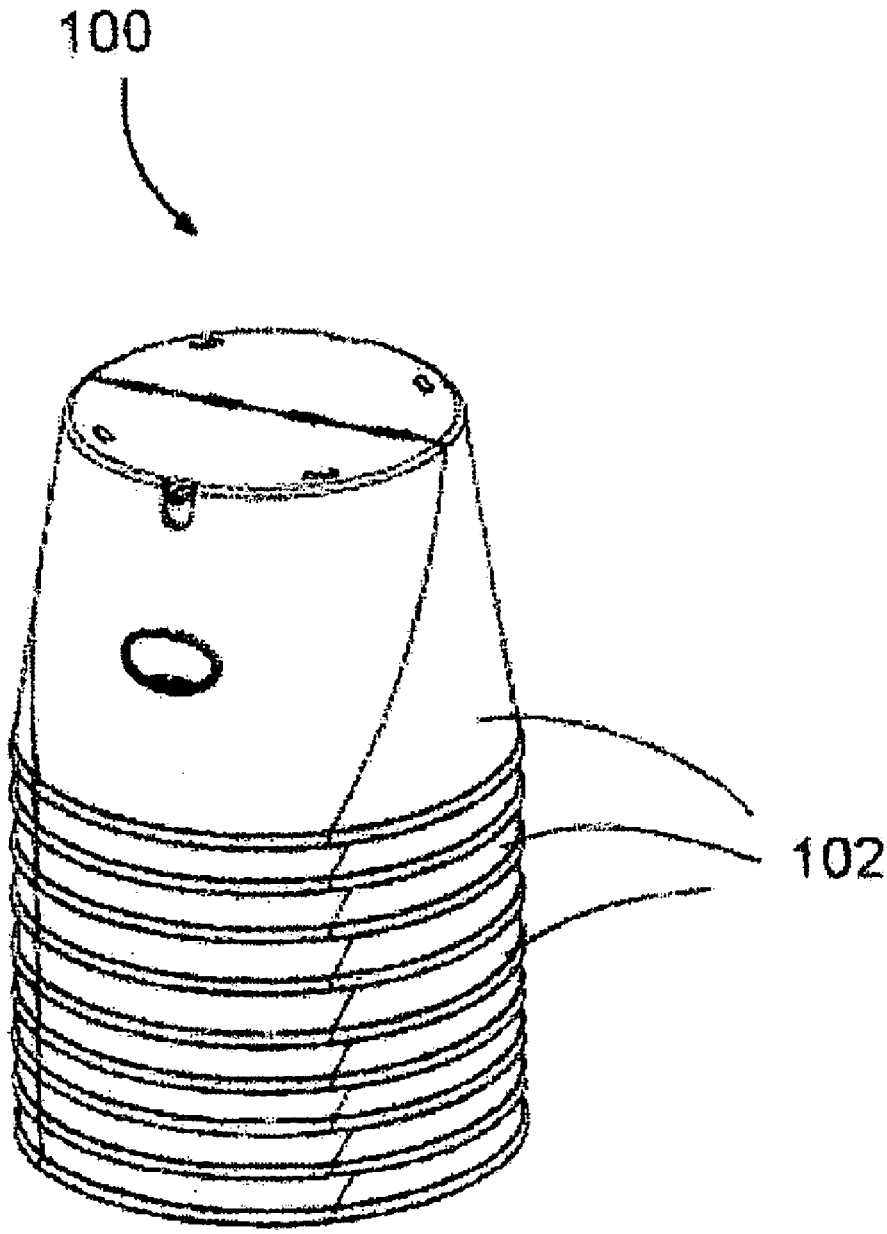
FIG. 5 depicts a plurality of multi-functional furniture items stacked in accordance with a preferred embodiment of the present invention.

Reference is now made to FIG. 5 depicting a plurality of multi-functional furniture items stacked in accordance with a preferred embodiment of the present invention. A stack 100 of a plurality of multi-functional furniture 102 is arranged. Stack 100 can be established when the furniture is arranges in a stool or table or container arrangement. In this way, the space that is occupied for a plurality of furniture is minimal.

It should be emphasized that a single hinge is provided in the furniture of the present invention and it is very easy to handle. The stackable multi-functional furniture has a single hinge connecting two portions wherein one of the two portions is adapted to rotate about the hinge so that in some arrangements such as the container or the table/stool, a surface comprising a portion of both portions is formed and in another arrangement, which establishes a chair, one of the portions is rotated about the hinge so that one portion is on top of the other.

It should be noted that the multi-functional furniture can be produces by any method in accordance to the material from which the furniture is made of. Additions such as cushion in order to make the furniture more comfortable can be provided in the furniture without limiting the scope of the present invention.

It should be clear that the description of the embodiments and attached Figures set forth in this specification serves only for a better understanding of the invention, without limiting its scope as covered by the following Claims.

It should also be clear that a person skilled in the art, after reading the present specification can make adjustments or amendments to the attached Figures and above described embodiments that would still be covered by the following Claims.

The invention claimed is:

1. A stackable multi-functional furniture comprising a hollow container-shaped member diagonally and unequally cut into two portions that are connected by a hinge wherein said two portions are arranged about said hinge to establish different furniture items, wherein said two portions comprises:

a first portion adapted to act as a support in some functions of the furniture, wherein said first portion has a horizontal surface;

a second portion having a second surface connected to said first portion through said hinge provided between said horizontal surface and said second surface wherein said second portion is adapted to partially rotate substantially in 180° about said hinge between a first position in which said horizontal surface is aligned with said second surface and a second position in which said second surface is adjacently mounted on top of said horizontal surface;

whereby, in the first position of the furniture, a container is established wherein turning the container upside down forms another function which is a stool or a table, and wherein rotating said second portion about said hinge in an upward position to said second position forms a chair.

2. The furniture as claimed in claim 1, wherein a seat is provided connected to said first portion so as to allow a load to be mounted on the seat when the furniture is arranged in said second position.

3. The furniture as claimed in claim 2, wherein said seat is hidden beneath said horizontal surface and said second surface when the furniture is arranged in said first position.

4. The furniture as claimed in claim 1, wherein said first portion is bigger than said second portion and provides the needed support to the furniture, especially when arranged as a chair.

5. The furniture as claimed in claim 1, further provided with a fastener adapted to lock said furniture when arranged in said second position.

6. The furniture as claimed in claim 1, further provided with a snap adapted to assure that said first position is secured.

7. The furniture as claimed in claim 1, wherein a plurality of the furniture can be stacked when arranged in said first position.

8. The furniture as claimed in claim 1, wherein said horizontal surface and said second surface is provided with raisers adapted to lift the surfaces off the ground when said furniture is arranged as a container.

* * * * *